US008682196B2

(12) United States Patent
Tanaka

(10) Patent No.: US 8,682,196 B2
(45) Date of Patent: Mar. 25, 2014

(54) IMAGE PROCESSING APPARATUS

(75) Inventor: Tomio Tanaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 868 days.

(21) Appl. No.: 12/238,510

(22) Filed: Sep. 26, 2008

(65) Prior Publication Data

US 2009/0096290 A1 Apr. 16, 2009

(30) Foreign Application Priority Data

Sep. 27, 2007 (JP) ..... 2007-251361

(51) Int. Cl.
*G03G 15/00* (2006.01)

(52) U.S. Cl.
USPC ..... 399/85; 399/70; 399/88

(58) Field of Classification Search
USPC ..... 399/38, 70, 75, 81, 82, 85, 88; 307/38, 307/39
See application file for complete search history.

(56) References Cited

U.S. PATENT DOCUMENTS

| | | | | |
|---|---|---|---|---|
| 5,761,575 | A * | 6/1998 | Kimoto | 399/70 |
| 5,974,284 | A * | 10/1999 | Sato et al. | 399/76 |
| 6,335,797 | B1 * | 1/2002 | Hirosawa | 358/1.15 |
| 7,395,121 | B2 * | 7/2008 | Aoki | 700/1 |
| 2004/0101323 | A1 * | 5/2004 | Shishikura | 399/44 |

FOREIGN PATENT DOCUMENTS

JP 2005-297264 A 10/2005

* cited by examiner

*Primary Examiner* — Benjamin Schmitt
(74) *Attorney, Agent, or Firm* — Panitch Schwarze Belisario & Nadel LLP

(57) ABSTRACT

An image processing apparatus includes a plurality of drive units, a control unit, and an operation information input unit. The plurality of drive units drive based on electric power supplied. The control unit shifts the plurality of drive units to a power saving state or a normal state. The operation information input unit is sequentially input first operation information indicating a start of a process and second operation information indicating a process content. The control unit shifts the plurality of drive units to the normal state when the first operation information is input to the operation information input unit with the plurality of drive units being in the power saving state. The control unit shifts a particular drive unit to the power saving state based on the second operation information when the second operation information is input.

16 Claims, 8 Drawing Sheets

| USING UNIT | PROCESS CONTENT | | | | | | |
|---|---|---|---|---|---|---|---|
| | PRINT | COPY | SCAN | FACSIMILE (TRANSMISSION) | FACSIMILE (RECEPTION) | DEVICE INFO. PRINT | AUTHENTICATION PRINT |
| READING UNIT | × | ○ | ○ | ○ | × | × | × |
| PRINT UNIT | ○ | ○ | × | × | ○ | ○ | ○ |

○: USE ×: NOT USE

IMAGE PROCESSING APPARATUS

BACKGROUND OF THE INVENTION

1. Field of the Invention

The present invention relates to an image processing apparatus.

2. Description of Related Art

Conventionally, a digital multi-functional apparatus integrating a plurality of image processing units such as a photocopier, a printer, and a facsimile machine is known. For the printer of such a digital multi-functional apparatus, employment of an electrophotographic method is commonly known in the art. Such an electrophotographic printer includes a fixing device fixing a toner image transferred and formed on a recording medium such as a sheet of paper with application of heat and pressure. Such a fixing device includes a heat mechanism such as a heater and the like, and temperature of the heating mechanism is increased to and is maintained at a certain level by a temperature control circuit and a temperature sensor. A heat process of such a heat mechanism is executed when a power source is activated or when the multi-functional apparatus is shifted from a standby state to start-up. Here, the multi-functional apparatus is not capable of executing a print process until a series of preprocesses, for example, the heat mechanism is heated to fixable temperature, is finished. However, the time needed for preprocesses is expected to be reduced from a standpoint of convenience of the apparatus or an energy saving. Japanese Un-examined Patent Application Publication No. 2005-297264 discloses a reduction of such time.

Particularly, an image forming apparatus in the document cited above only warms up an element involving a function selected by a user or a function provided with a job input, thereby realizing the energy saving.

Although such an image forming apparatus limits the function to be warmed up so as to realize the energy saving, the selected function becomes usable after a function block including plural functions to be needed is warmed up, causing a problem of prolonging the time needed for the preprocesses.

It is an object of the present invention to provide an image processing apparatus such as a multi-functional apparatus having plural functions with enhancement of convenience and an energy saving thereof.

BRIEF SUMMARY OF THE INVENTION

According to one aspect of the invention, an image processing apparatus includes: a plurality of drive units driving based on electric power supplied; a control unit shifting the plurality of driving units to a power saving state or a normal state; and an operation information input unit being sequentially input first operation information indicating a start of a process and second operation information indicating a process content. The control unit shifts the plurality of drive units to the normal state when the first operation information is input to the operation information input unit with the plurality of drive units being in the power saving state. The control unit shifts a particular drive unit to the power saving state based on the second operation information when the second operation information is input.

According to another aspect of the present invention, an image processing apparatus includes: a plurality of image processing units; a control unit shifting the plurality of image processing units to a power saving state or a normal state; and an operation information input unit being sequentially input first operation information indicating a start of an image process and second operation information indicating a content of the image process. The control unit shifts the plurality of image processing units to the normal state when the first operation information is input to the operation information input unit with the plurality of image processing units being in the power saving state. The control unit shifts a particular image processing unit to the power saving state based on the second operation information when the second operation information is input.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
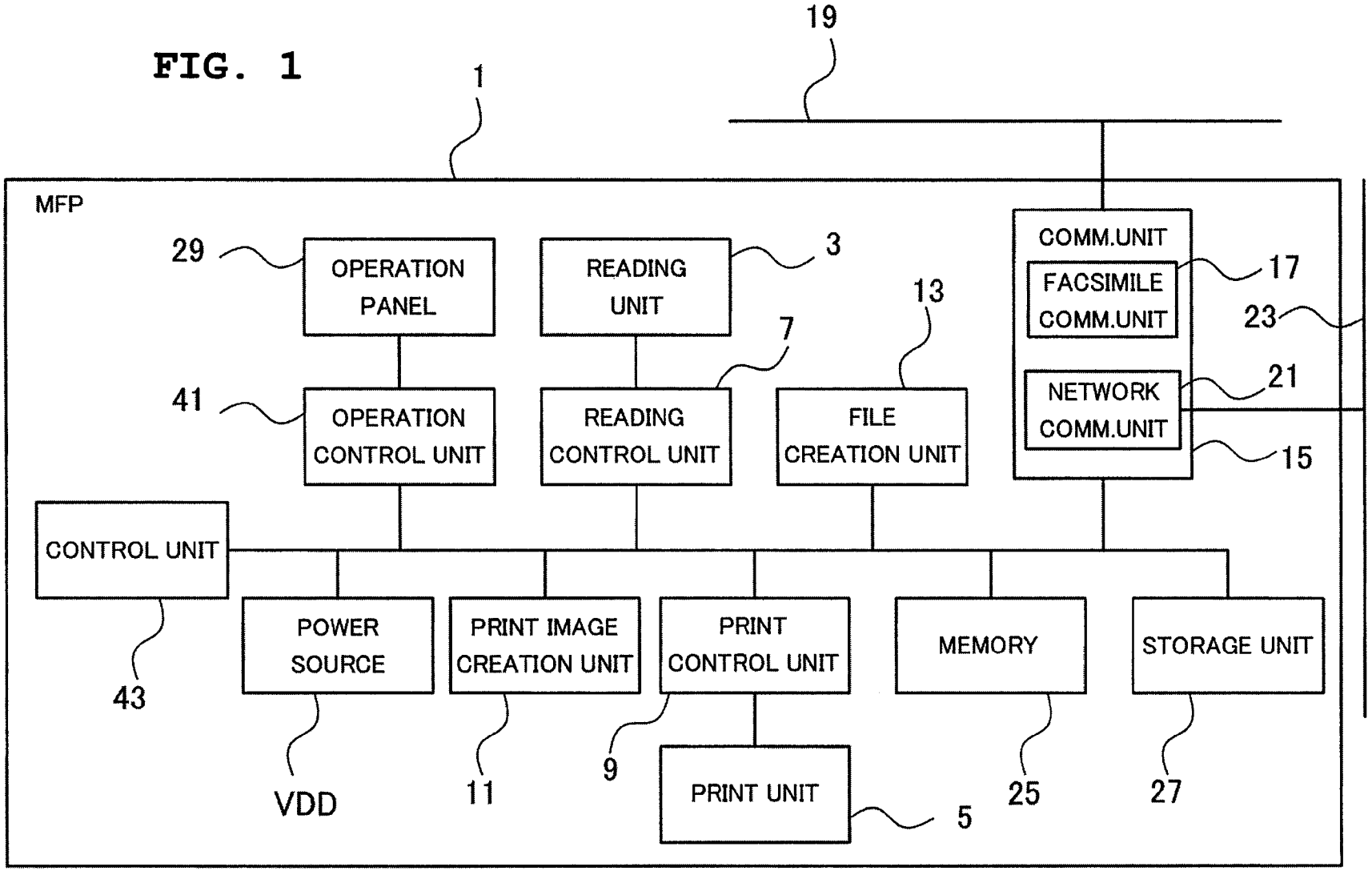
FIG. 1 is a block diagram illustrating a multi-functional peripheral according to an embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

Referring to FIG. 1, a multi functional peripheral (hereafter referred to as MFP) 1 serving as an image processing apparatus according to an embodiment of the present invention is illustrated. The MFP 1 includes a reading unit 3 serving as an image processing unit and a print unit 5 each of which is driven based on electric power supplied from a power source VDD.

The reading unit 3 scans a sheet placed on a prescribed reading table. The reading unit 3 makes a prescribed light source emit light to irradiate the sheet with the light at the time of scanning. The reading unit 3 detects reflection light reflected from the sheet with an image pickup element and reads an image printed on the sheet. Although the light source included in the reading unit 3 is driven based on the electric power supplied from the power source VDD, supply of the electric power to the light source is halted when the MFP 1 shifts to a power saving state. On the other hand, the supply of the electric power is resumed when the MFP 1 shifts from the power saving state to a normal state in which a reading process and the like are executable. However, a certain time period is needed for the reading unit 3 to obtain an adequate light amount from the light source for image reading. Such a reading unit 3 is driven under the control of a reading control unit 7, and the image read by the reading unit 3 is supplied to the reading control unit 7.

The print unit 5 includes a development device forming a toner image based on image information input, a transfer device transferring the toner image onto the sheet, and a fixing device fixing the toner image on the sheet. Since such a print unit 5 includes a drive device consuming a relatively large amount of the electric power such as a photosensitive drum carrying a latent image, the supply of the electric power to the development device including the photosensitive drum, the transfer device, the fixing device and the like is halted when the MFP 1 shifts to the power saving state. When the MFP 1 shifts from the power saving state to the normal state executable of the print process and the like, the supply of the electric power to the development device, the transfer device, and the fixing device is resumed. However, specifically, the fixing device needs a certain time period to increase temperature of a heat mechanism to a fixable level. Such a print unit 5 is driven under the control of the print control unit 9.

The reading control unit 7 controls the reading unit 3. The reading control unit 7 generates an intermediate image data based on the image supplied from the reading unit 3. Where the MFP 1 copies the image, the reading control unit 7 supplies the generated intermediate image data to a print image creation unit 11. On the other hand, where the MFP 1 scans the image and supplies the image as image data to information process device, the reading control unit 7 supplies the intermediate image data generated to a file creation unit 13.

The print image creation unit 11 generates image data of a bitmap format recognizable by the print control unit 9 based on the intermediate image data supplied from the reading control unit 7. The print image creation unit 11 supplies the generated image data of the bitmap format to the print control unit 9. Where the MFP 1 transmits the image through a facsimile function, the image data created by the print image creation unit 11 is sent out to a telephone line 19 by a fax communication unit 17 included in a communication unit 15 and is transmitted to a recipient.

The print control unit 9 controls each of the elements included in the print unit 5 based on the image data supplied from the print image creation unit 11, so that the toner image corresponding to the image data is printed on the sheet.

The file creation unit 13 creates an image file of an application format, for example, a PDF format, a TIFF format, and a JPEG format, based on the intermediate image generated by the reading control unit 7. The image file created by the file creation unit 13 is sent out to a network 23 by a network communication unit 21 included in the communication unit 15 and is provided to the information process device.

Figures 2, 3:
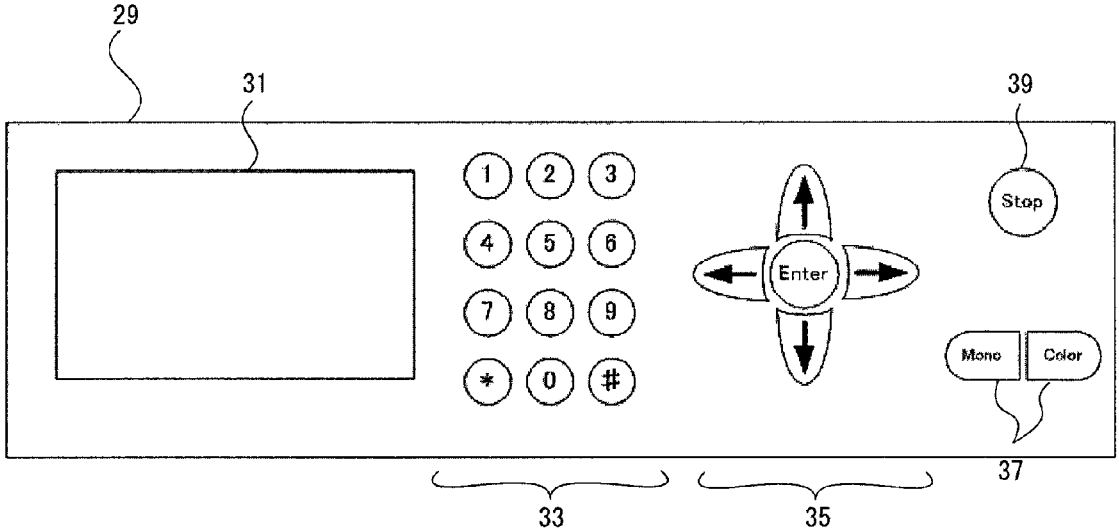
FIG. 2 is a schematic diagram illustrating an example of using unit information to be stored in the multi-functional peripheral of FIG. 1.
FIG. 3 is a plan view illustrating an operation panel included in the multi-functional peripheral of FIG. 1.

The MFP 1 includes a memory 25 having a random access memory (RAM) and the like serving as a work area of the print image creation unit 11 or the file creation unit 13 and a storage unit 27 having a nonvolatile storage medium such as Flash or a hard disk drive (HDD). Particularly, the storage unit 27 stores using unit information indicating which drive unit to be used in correspondence to a process content. As illustrated in FIG. 2, the using unit information includes the process content designated by a user and a unit to be used to execute the process, and the process content and the unit are associated with each other. An example case illustrated in FIG. 2, where an image based on print data input from an external information process device is printed, the print unit 5 is used while the reading unit 3 is not used. Accordingly, information corresponding to a field of "PRINT" in the process content of the using unit information is stored in the example case. Use of such using unit information allows the MFP 1 to save the supply of the electric power to a unit that is not needed to be used according to the process content designated by the user. Therefore, the MFP can ensure an energy saving.

Moreover, the MFP 1 includes an operation panel 29 through which the user inputs various information to the MFP 1. The operation panel 29 displays the various information to the user. As illustrated in FIG. 3, the operation panel 29 includes a display device 31 displaying the various information to the user, a character input key 33 for inputting information such as a character by the user, a movement/selection key 35 for shifting to various setting menus, a start key 37 having a "Color" key for executing a color print and the like and a "Mono" key for executing a monochrome print and the like, and a stop key 39 for stopping operation in execution or setting. The information displayed in the display device 31 is controlled by an operation control unit 41. The information input to each of the keys of the character input key 33, etc., is supplied to a control unit 43 through the operation control unit 41.

The control unit 43 controls each of the elements included in the MFP 1. Particularly, the control unit 43 supplies a command to start a reading process or a print process to the reading control unit reading control unit 7 or the print control unit print control unit 9, etc. based on a command input the operation panel 29. When the operation panel 29 is not operated or the print data from the external device is not input within a prescribed time period, the control unit 43 controls to halt the supply of the electric power to the light source or the fixing device consuming a relatively large amount of the electric power among the elements included in the reading unit 3 and the print unit 5, so that the reading unit 3 and the print unit 5 are shifted to the power saving state. Where the reading unit 3 and the print unit 5 are in the power saving state, and where the user inputs first operation information (described later) by pressing down any of the keys of the operation panel 29 or inputting the print data, the control unit 43 controls the reading unit 3 and the print unit 5 to be shifted to the normal state. Where second operation information (described later) designating a particular process content is input subsequent to the first operation information, the control unit 43 refers to the second operation information and the using unit information stored in the storage unit 27 to execute a process of shifting a unit not to be used to the power saving state.

The first operation information may represent information input by the user to the MFP 1 by pressing down any of the keys of the operation panel 29 where the MFP 1 is in the power saving state. When such first operation information is input to the MFP 1, the MFP 1 shifts from the power saving state to the normal state. The first operation information may also represent a detection result detected by a sensor of the MFP 1 where, for example, the user places an original document on a reading table of the reading unit 3. Where the original document is placed on the reading table of the reading unit 3, the MFP 1 determines that the user intends to use the facsimile function or the copy function, and recognizes a detection signal of the original document as the first operation information. When the first operation information is input, the MFP 1 starts a warm-up process that shifts the reading unit 3 and the print unit 5 to the normal state.

Figure 4:
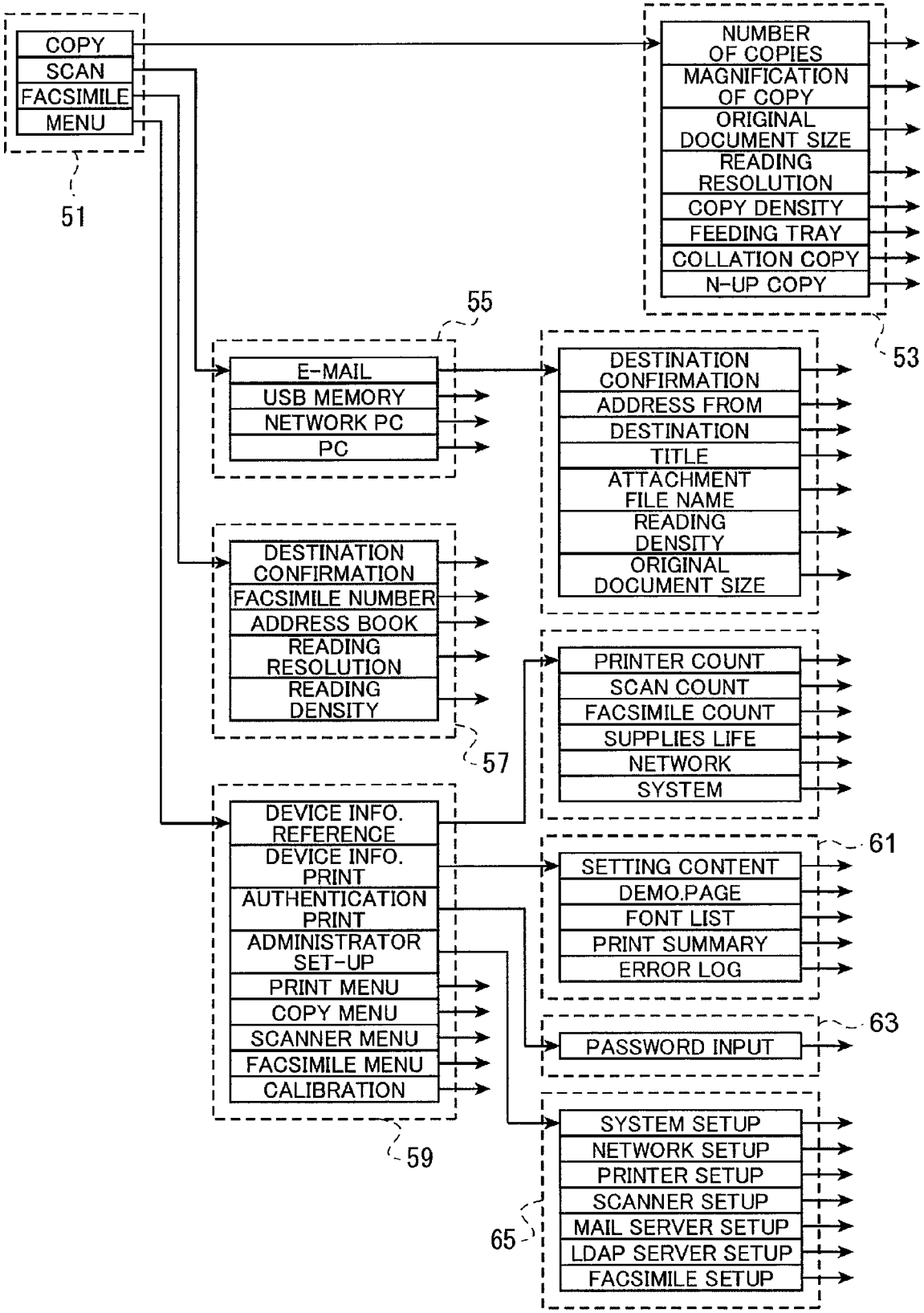
FIG. 4 is a schematic diagram illustrating an example of screen displayed in a display device.

The second operation information represents information relating to the particular process content designated by the user. Particularly, when the first operation information is input, the display device 31 displays a main menu 51 as illustrated in FIG. 4. The main menu 51 is a screen facilitating the user to select a desired particular process content, so that the user selects a particular process using the movement/selection key 35 while referring to the display device 31.

For example, where the user selects "COPY" from the main menu screen 51, the MFP 1 determines that a command to copy is input as the second operation information. Such a command is supplied to the control unit 43. Here, the MFP 1 makes the display device 31 display a copy menu screen 53 so as to facilitate the user to select various settings. Here, the MFP 1 determines that both of the reading unit 3 and the print unit 5 are used in the course of copying, and continues the warm-up process of shifting the reading unit 3 and the print unit 5 to the normal state. The MFP 1 executes a series of copy processes after the warm-up process of the reading unit 3 and the print unit 5 is completed.

Where the user selects "SCAN" from the main menu screen 51, the MFP 1 makes the display device 31 display a scan menu screen 55 and determines that a command to scan is input as the second operation information. When such a command is input to the control unit 43, the control unit 43 refers to the using unit information stored in the storage unit 27 and determines that the print unit 5 is not used in the course of scanning. The control unit 43 supplies a command to halt the warm-up process of the print unit 5 to the print control unit 9. The MFP 1 executes a series of scanning processes after the warm-up process of the reading unit 3 is completed.

Where the user selects "FAX" from the main menu screen 51, the MFP 1 makes the display device 31 display a fax menu screen 57 and determines that the second operation information corresponding to a command to make such a selection is input. When the command is input to the control unit 43, the control unit 43 refers to the using unit information stored in the storage unit 27 and determines that the print unit 5 is not used in the course of transmitting the facsimile. The control unit 43 supplies a command to halt the warm-up process of the print unit 5 to the print control unit 9. The MFP 1 executes a facsimile process including a reading process of the original document and a transmission process of the original document read by the reading process after the warm-up process of the reading unit 3 is completed.

Where the user selects "MENU" from the main menu screen 51, the MFP 1 makes the display device 31 display a menu screen 59. Here, the MFP 1 determines that the reading unit 3 is not used for processes of "DEVICE INFORMATION PRINT" and "AUTHENTICATION PRINT" each of which is selectable from the menu screen 59, and supplies a command to halt the warm-up process of the reading unit 3 to the reading control unit 7. For example, where the "DEVICE INFORMATION PRINT" is selected from the menu screen 59, the control unit 43 makes the display device 31 display a device information print menu 61. For example, where the "AUTHENTICATION PRINT" is selected from the menu screen 59, the control unit 43 makes the display device 31 display an authentication print menu 63.

For example, where "ADMINISTRATOR SET-UP" is selected from the menu screen 59, the control unit 43 determines that a purpose of the user is administration, not using each function of the MFP 1, and controls to halt the warm-up process of the reading unit 3 and the print unit 5. Here, the control unit 43 makes the display device 31 display an administrator set-up menu 65. Therefore, the MFP 1 can reduce the electric power consumption in a case where the user begins to operate the MFP 1 except for the purpose of using each function thereof.

When the second operation information is not input from the user for a certain time period after each of the menus is displayed in the display device 31, the MFP 1 makes the screen to be displayed on the display device 31 return to the main menu screen 51. The control unit 43 controls to halt the warm-up process of the reading unit 3 and the print unit 5.

A description is now given of operation of the MFP 1.

Figure 5:
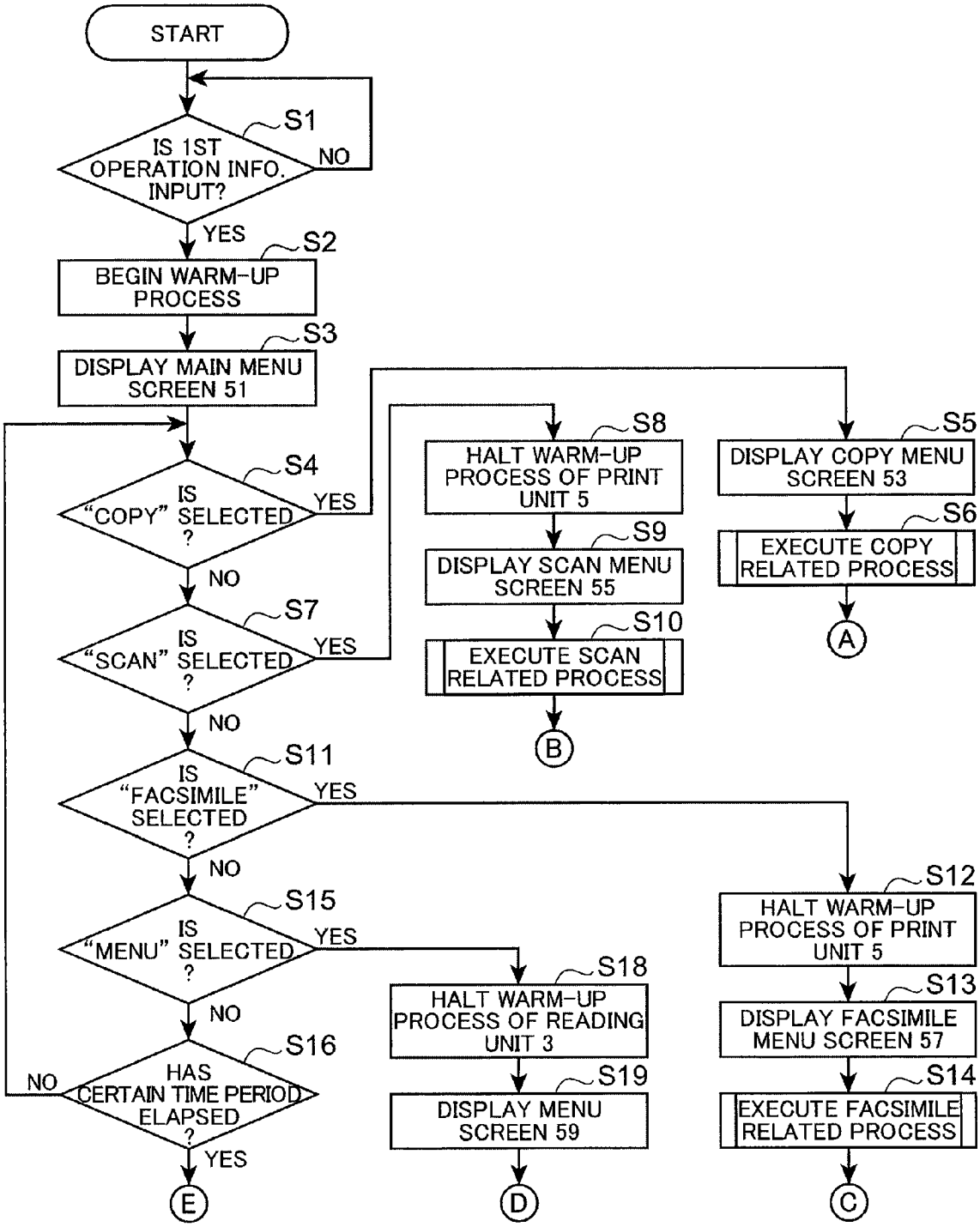
FIG. 5 is a flowchart illustrating an example procedure for operation of the multi-functional peripheral of FIG. 1.
Figure 6:
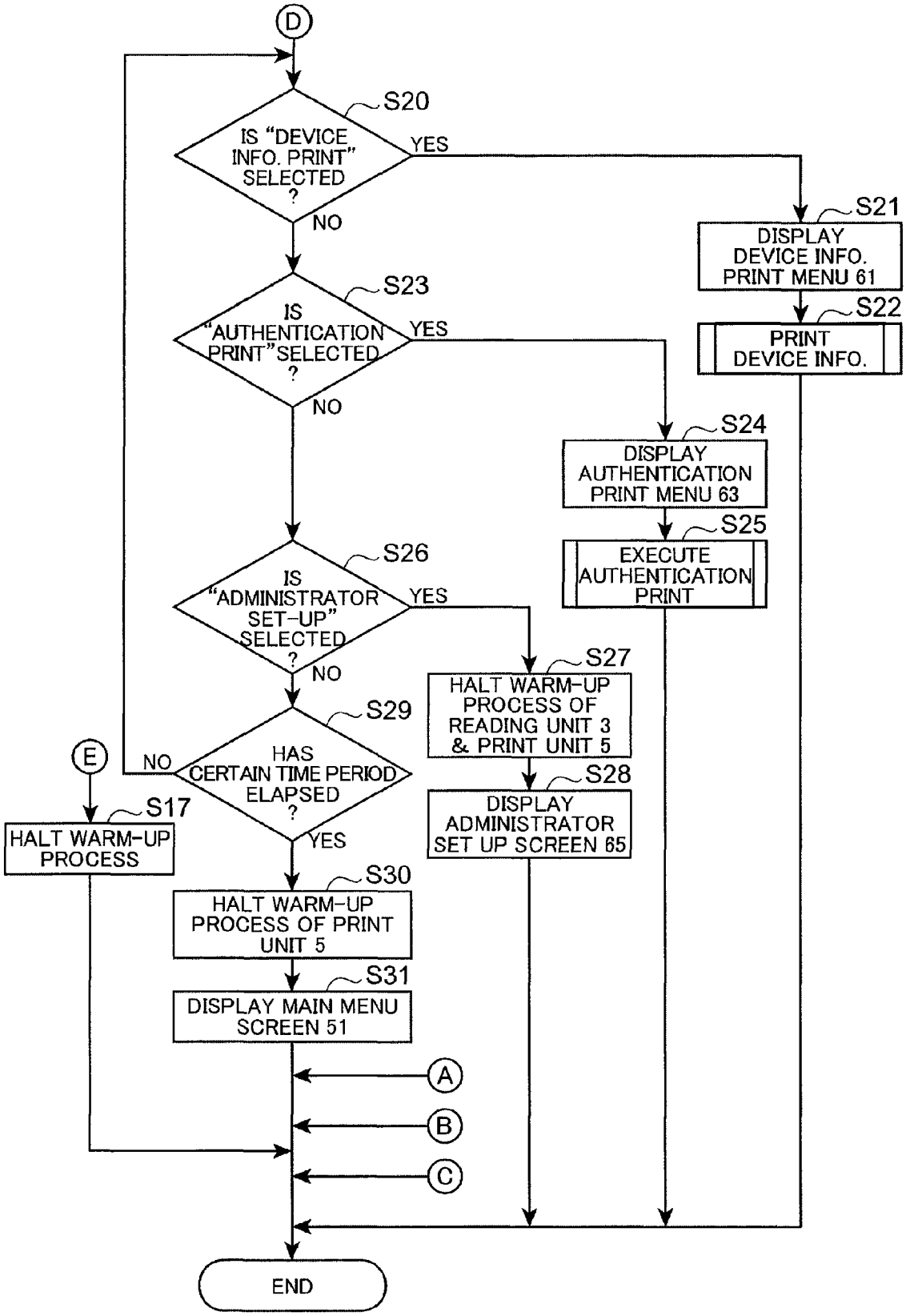
FIG. 6 is a flowchart illustrating an example procedure for operation of the multi-functional peripheral of FIG. 1.

Referring to flowcharts of FIGS. 5 and 6, example procedures for operation of the control unit 43 are explained where the MFP 1 as a whole is in the power saving state after a certain time period has elapsed from a time of last used.

When the MFP 1 as a whole shifts to the power saving state, and a series of processes is started, the control unit 43 determines whether or not the first operation information is input in step S1. Particularly, the control unit 43 determines based on presence or absence of notification of pressing down any of the keys of the operation panel 29 from the operation control unit 41. The control unit 43 repeats the process until the first operation information is input.

In step S2, the control unit 43 supplies a start command to warm-up the reading unit 3 and the print unit 5 to the reading control unit 7 and the print control unit print control unit 9, respectively. Consequently, the reading control unit 7 controls to start supplying the electric power to the light source of the reading unit 3. The print control unit 9 controls to start supplying the electric power to the fixing device of the print unit 5.

In step S3, the control unit 43 makes the display device 31 display the main menu screen 51. Particularly, the control unit 43 supplies a command to display the main menu screen 51 to the operation control unit 41.

The control unit 43 detects the presence or the absence of input of the second operation information in step S4 and subsequent steps.

Particularly, in step S4, the control unit 43 determines whether or not "COPY" is selected. Where "COPY" is selected (Yes in step S4), the control unit 43 determines to use both of the reading unit reading unit 3 and the print unit 5 based on the using unit information. Subsequently, the control unit 43 makes the display device 31 display the copy menu screen 53 in step S5. Next, in step S6, the control unit 43 executes a copy related process selected by the user, and the series of processes ends.

Where "COPY" is not selected (No in step S4), the control unit 43 determines whether or not "SCAN" is selected in step S7. Where "SCAN" is selected (Yes in step S7), the control unit 43 determines not to use the print unit 5 in the course of scanning based on the using unit information. In step S8, the control unit 43 controls to halt the warm-up process of the print unit 5. Next, in step S9, the control unit 43 makes the display device 31 display the scan menu screen 55 so as to facilitate the user to input a command. In step S10, the control unit 43 executes a scan related process, and the series of processes ends.

Where "SCAN" is not selected (No in step S7), the control unit 43 determines whether or not "FAX" is selected in step S11. Where "FAX" is selected (Yes in step S11), the control unit 43 determines not to use the print unit 5 based on the using unit information. In step S12, the control unit 43 controls to halt the warm-up process of the print unit 5. Subsequently, the control unit 43 makes display device 31 display the facsimile menu 57 so as to facilitate the user to input a command in step S13. Next, in step S14, the control unit 43 executes a fax related process, and the series of processes ends.

Where "FAX" is not selected (No in step S11), the control unit 43 determines whether or not "MENU" is selected in step S15. Where "MENU" is not selected (No in step S15), the control unit 43 determines whether or not a certain time period has elapsed from a time of displaying the main menu screen 51 in step S16. Where the certain time period has not elapsed (No in step S16), the control unit 43 re-executes steps beyond step S4. On the other hand, where the certain time period has elapsed from a time of displaying the main menu screen 51 (Yes in step S16), the control unit 43 determines as the absence of input of the second operation information and controls to halt the warm-up process of both of the reading unit reading unit 3 and the print unit 5 in step S17, and the series of processes ends.

Where "MENU" is selected (Yes in step S15), the control unit 43 determines not to use the reading unit reading unit 3 in the processes of "DEVICE INFORMATION PRINT" and "AUTHENTICATION PRINT" selectable from the menu screen 59, and controls to halt the warm-up process of the reading unit reading unit 3 in step S18. Subsequently, the control unit 43 makes the display device 31 display the menu screen 59 in step S19. The control unit 43 determines whether or not "DEVICE INFORMATION PRINT" is selected in step S20. Where "DEVICE INFORMATION PRINT" is selected (Yes in step S20), the control unit 43 makes the display device 31 display the device information print menu 61 in step S21. In step S22, the control unit 43 executes a process relating to the device information print selected by the user, for example, printing of error log, and the series of process ends.

Where "DEVICE INFORMATION PRINT" is not selected (No in step S20), the control unit 43 determines whether or not "AUTHENTICATION PRINT" is selected in step S23. Where "AUTHENTICATION PRINT" is selected (Yes in step S23), the control unit 43 makes the display device 31 display the authentication print menu 63 in step S24. Subsequently, in step S25, the control unit 43 executes the authentication print, and the series of processes ends.

Where "AUTHENTICATION PRINT" is not selected (No in step S23), the control unit 43 determines whether or not "ADMINISTRATOR SET-UP" is selected in step S26. Where "ADMINISTRATOR SET-UP" is selected (Yes in step S26), the control unit 43 controls to halt the warm-up process of the reading unit 3 and the print unit 5 in step S27. The control unit 43 makes the display device 31 display the administrator set-up menu 65 in step S28. Subsequently, the control unit 43 finishes the series of processes.

Where "ADMINISTRATOR SET-UP" is not selected (No in step S26), the control unit 43 determines whether or not a certain time period has elapsed from a time of displaying the menu screen 59. Where the certain time period has not elapsed (No in step S29), the control unit 43 re-executes the processes beyond step S20.

On the other hand, where the certain time period has elapsed (Yes in step S29), the control unit 43 controls to halt the warm-up process of the print unit 5 in step S30. After the control unit 43 makes the display device 31 display the main menu screen 51 in step S31, the series of processes ends.

Figure 7:
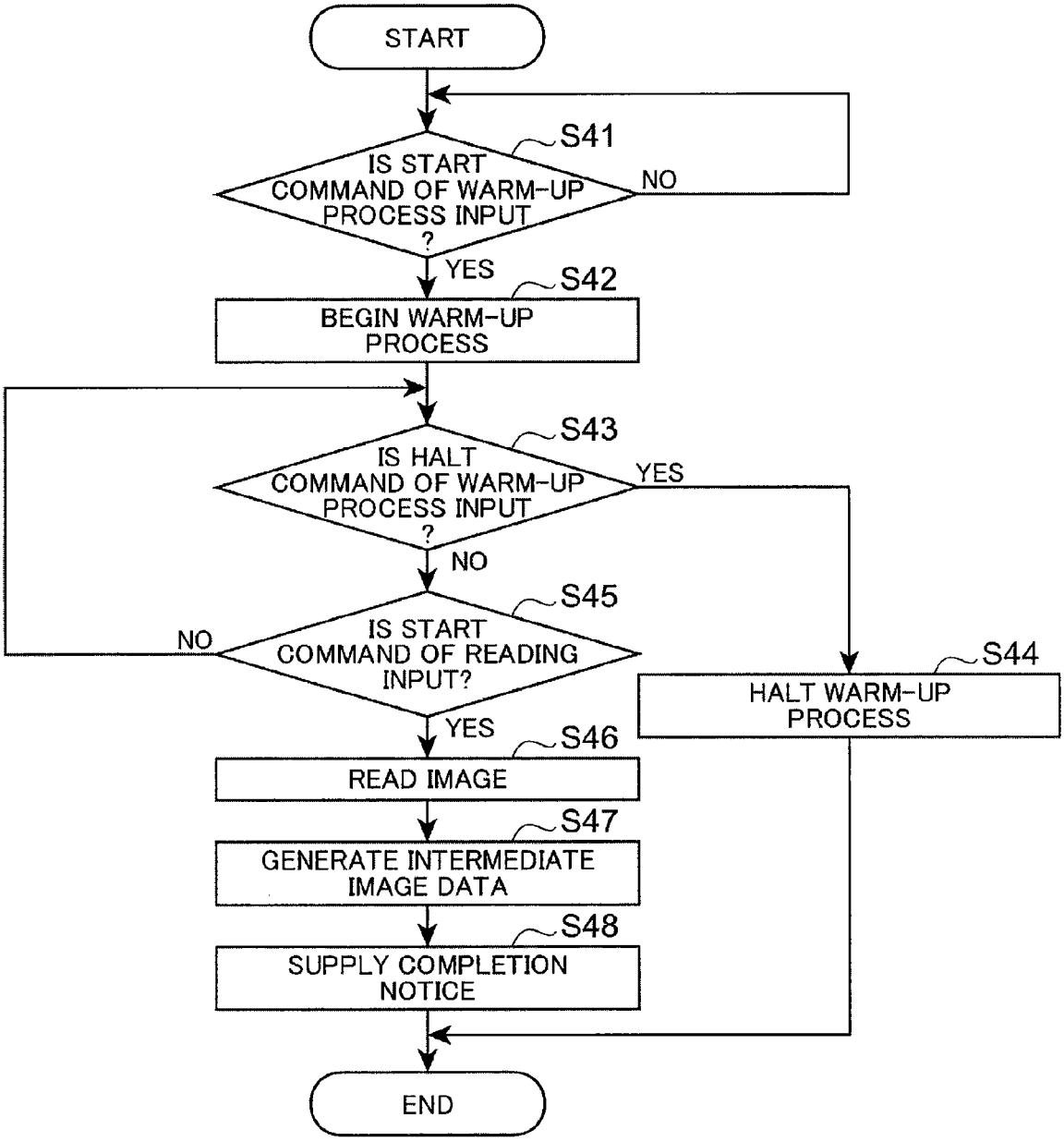
FIG. 7 is a flowchart illustrating another example procedure for operation of the multi-functional peripheral of FIG. 1.

Referring to a flowchart of FIG. 7, an example procedure for operation of the reading control unit 7 is explained with respect to the series of the processes described above.

When the series of the processes is started, in step S41, the reading control unit 7 determines whether or not a command to start the warm-up process is input from the control unit 43. Particularly, the command, which is input where the first operation information is determined by the control unit 43 as being input, is input. The reading control unit 7 repeatedly executes the process until the command to start the warm-up process is input.

In step S42, the reading control unit 7 starts the warm-up process of the reading unit reading unit 3. Particularly, the reading control unit 7 controls the power source VDD to resume supplying the electric power to the light source being halted with the supply of the electric power.

Subsequently, in step S43, the reading control unit 7 determines whether or not a command to halt the warm-up process is input from the control unit 43. Particularly, where the control unit 43 determines that the second operation information is input, and where the reading unit 3 is determined not to be used, the command is input. Where the command to halt the warm-up process is input (Yes in step S43), the reading control unit 7 controls to halt the warm-up process of the reading unit 3 in step S44, and the series of processes ends.

On the other hand, where the command to halt the warm-up process is not input (No in step S43), the reading control unit 7 determines whether or not a command to start reading is input in step S45. Particularly, the command, which is input where a start command of the facsimile or the scan is determined by the control unit 43 as being input to the operation panel 29 by the user, is input. Where the start command of reading is not input (No in step S45), the reading control unit 7 repeatedly executes steps beyond step S43.

Where the start command of reading is input (Yes in step S45), the reading control unit 7 controls to read the placed image in step S46. In step S47, the reading control unit 7 generates the intermediate image data of the image read in step S46. The reading control unit 7 supplies the notification of completion of reading to the control unit 43 in step S48. Then, the reading control unit 7 finishes the series of processes.

Figure 8:
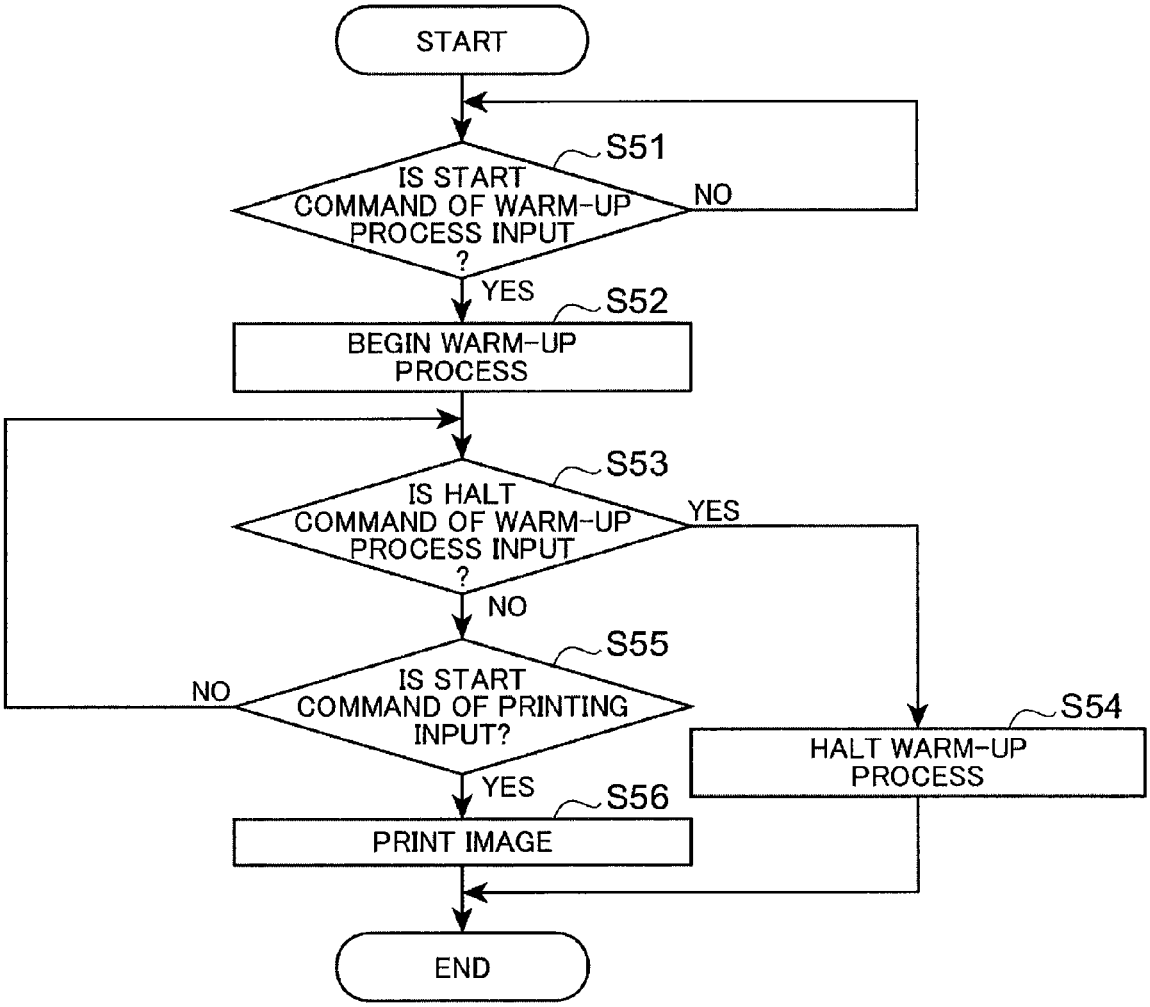
FIG. 8 is a flowchart illustrating another example procedure for operation of the multi-functional peripheral of FIG. 1.

Referring now to a flowchart of FIG. 8, an example procedure for operation of the print control unit 9 is explained with respect to the series of the processes described above.

When the series of the processes is started, the print control unit 9 determines whether or not a command to start the warm-up process is input from the control unit 43 in step S51. Particularly, the command, which is input where the first operation information is determined by the control unit 43 as being input, is input. The print control unit 9 repeatedly executes the process until the command to start the warm-up process is input.

Next, in step S52, the print control unit 9 starts the warm-up process of the print unit 5. In such a process, the print control unit 9 controls the power source VDD to resume supplying the electric power to the fixing device being halted with the supply of the electric power.

In step S53, the print control unit 9 determines whether or not a command to halt the warm-up process is input from the control unit 43. Particularly, where the control unit 43 determines that the second operation information is input, and where the print unit 5 is determined not to be used, the command is input. Where the command to halt the warm-up process is input (Yes in step S53), the print control unit 9 controls to halt the warm-up process of the print unit 5 in step S54, and the series of the processes ends.

On the other hand, where the command to halt the warm-up process is not input (No in step S53), the print control unit 9 determines whether or not a start command of printing is input in step S55. Particularly, the command, which is input where a start command of printing is determined by the control unit 43 as being input to the operation panel 29 by the user, is input. Where the start command of printing is not input (No in step S55), the print control unit 9 repeatedly executes steps beyond step S 53.

Where the start command of printing is input (Yes in step S55), the print control unit 9 prints the designated image in step S56, and the series of processes ends.

Figure 9:
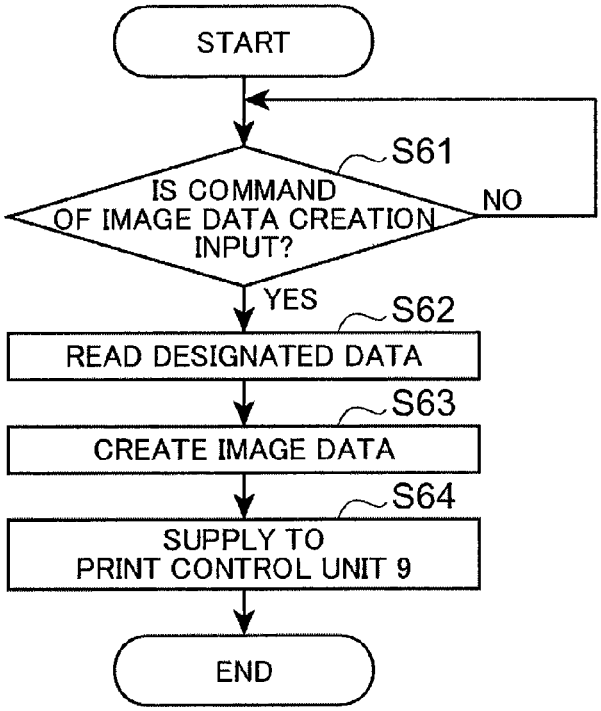
FIG. 9 is a flowchart illustrating yet another example procedure for operation for the multi-functional peripheral of FIG. 1.

Referring to a flowchart of FIG. 9, an example procedure for operation of the print image creation unit 11 is explained.

When the series of process is started, the print image creation unit 11 determines whether or not a command to create the image data is input in step S61. Particularly, the command to create the image data is input from the control unit 43 to the print image creation unit 11 where the control unit 43 determines the presence of print, copy, device information print, or authentication print, or where the control unit 43 determines that the facsimile is received through the telephone line 19. The print image creation unit 11 repeatedly executes the same process until the command is input.

Subsequently, the print image creation unit 11 reads the data designated by the control unit control unit 43 in step S62. Particularly, where a command of print or authentication print is input from the control unit 43, the print image creation unit 11 reads out the print data input to the MFP 1 through the network 23 and the network communication unit 21 and stored in the memory 25. Where a command of copy is input from the control unit 43, the print image creation unit 11 reads out the intermediate image data generated by the reading control unit 7. Where a command of facsimile reception is input from the control unit 43, the print image creation unit 11 reads out fax data input to the MFP 1 through the telephone line 19 and the fax communication unit 17 and stored in the memory 25. Where a command of device information print is input from the control unit 43, the print image creation unit 11 reads out the error log, etc., stored in the storage unit 27.

Subsequently, the print image creation unit 11 creates the image data of the bitmap format based on the data read in step S63. The print image creation unit 11 supplies the created image data to the print control unit 9 in step S64, and the series of processes ends. The print control unit 9 prints the image based on the image data supplied.

Figure 10:
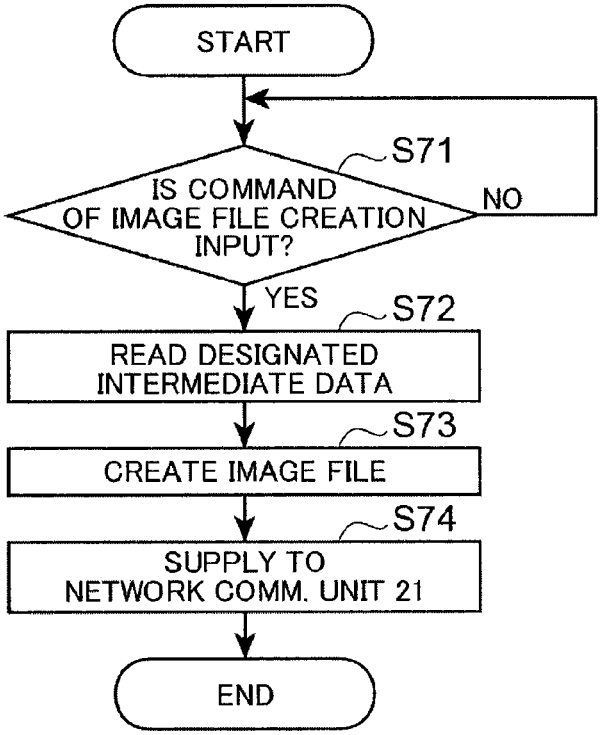
FIG. 10 is a flowchart illustrating still another example procedure for operation of the multi-functional peripheral of FIG. 1.

Referring to a flowchart of FIG. 10, an example procedure for operation of the file creation unit 13 is explained.

When the series of processes is started, the file creation unit 13 determines whether or not a command to create the image file is input in step S71. Particularly, where the control unit 43 transmits a scanned image through e-mail, the command of the image file creation is input to the file creation unit 13 from the control unit 43. The file creation unit 13 repeatedly executes the same process until the command is input.

In step S72, the file creation unit 13 reads out the intermediate image data designated by the control unit 43 from the reading control unit 7. In step S73, the file creation unit 13 creates the image file of the application format based on the data read out. In step S74, the file creation unit 13 supplies the created image file to the network communication unit 21, and the series of processes ends. The network communication unit 21 transmits the image file supplied to a designated destination.

Therefore, the MFP 1 starts the warm-up process of the reading unit reading unit 3 and the print unit 5 at a time at which the user starts the operation of the operation panel 29, and halts the warm-up process in response to the particular process content input to the operation panel 29 by the user. Consequently, the MFP 1 can reduce a standby time of the user in the course of warm-up process. Moreover, the MFP 1 can halt the warm-up process of the unit not to be used, thereby reducing the electric power consumption thereof as a whole.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

For example, the MFP 1 is described as an example of the image processing apparatus in the embodiment above. However, the image processing apparatus is not limited to the MFP 1 and can be any apparatus having a plurality of image processing units.

What is claimed is:

1. An image processing apparatus comprising:

a first drive unit and a second drive unit driven based on electric power supplied thereto;

a control unit controlling electric power supply to each of the first and the second drive units; and an operation information input unit inputting sequentially first operation information and second operation information, the second operation information designating a process, wherein, in a case where a limitation is placed on the electric power supply to the first and the second drive units, when the first operation information is input, the control unit removes the limitation on the electric power supply to the first and the second drive units based on the input of the first operation information, and thereafter, upon the second operation information being input, the control unit determines which of the first and the second drive units is used in a designated process based on the second operation information, and limits the electric power supply to the second drive unit when the first drive unit is being used, and limits the electric power supply to the first drive unit when the second drive unit is being used.

2. An image processing apparatus according to claim 1, wherein the control unit limits the power supply by shifting the first and second drive units to a power saving state from a normal state, and wherein the first operation information indicates a commencement of a process.

3. The image processing apparatus according to claim 2 comprising a storage unit storing using unit information indicating which drive unit to be used between the first and second drive units in correspondence to the process content designated by the second operation information, wherein the control unit refers to the using unit information stored in the storage unit and shifts the drive unit not to be used, in a process involved in the process content indicated by the second operation information input to the operation information input unit, to the power saving state.

4. The image processing apparatus according to claim 3, wherein the process content designated by the second operation information includes any one of operations of "print", "copy", "scan", "facsimile transmission", "facsimile reception", "device information print" and "authentication print".

5. The image processing apparatus according to claim 3, wherein the drive unit not to be used is at least one of a reading unit and a print unit.

6. The image processing apparatus according to claim 3, wherein the plurality of drive units include a reading unit reading an image and a print unit printing the image, wherein the control unit shifts the reading unit and the print unit from the power saving state to the normal state when the first operation information is input, and wherein the control unit shifts the reading unit from the normal state to the power saving state and uses the print unit when any one of operations of "print", "facsimile reception", "device information print", and "authentication print" is input as the second operation information.

7. The image processing apparatus according to claim 3, wherein the plurality of drive units include a reading unit reading an image and a print unit printing the image, wherein the control unit shifts the reading unit and the print unit from the power saving state to the normal state when the first operation information is input, and wherein the control unit shifts the print unit from the normal state to the power saving state and uses the reading unit when an operation of either "scan" or "facsimile transmission" is input as the second operation information.

8. The image processing apparatus according to claim 2, wherein the first operation information is input by operation of an operation panel by a user.

9. The image processing apparatus according to claim 1, wherein in a case where the first operation information is input, the control unit starts supplying the electric power to the first and second drive units based on the input of the first operation information.

10. The image processing apparatus according to claim 9, wherein in a case where the first operation information is input, the control unit starts supplying the electric power to the plural drive units to which the electric power is not supplied based on the input of the first operation information.

11. The image processing apparatus according to claim 1, wherein one of the first and second drive units is a reading unit, and another of the plural drive units is a print unit.

12. The image processing apparatus according to claim 1, wherein one of the first and second drive units is a reading unit.

13. An image processing apparatus comprising:

a first image processing unit and a second image processing unit driven based on electric power supplied thereto;

a control unit controlling electric power supply to each of the first and the second image processing units; and an operation information input unit inputting sequentially first operation information and second operation information, the second operation information designating a process, wherein, in a case where a limitation is placed on the electric power supply to the first and the second image processing units, when the first operation information is input, the control unit removes the limitation on the electric power supply to the first and the second image processing units based on the input of the first operation information, and thereafter, upon the second operation information being input, the control unit determines which of the first and the second image processing units is used in a designated process based on the second operation information, and limits the electric power supply to the second image processing unit when the first image processing unit is being used, and limits the electric power supply to the first image processing unit when the second image processing unit is being used.

14. The image processing apparatus according to claim 13, wherein in a case where the first operation information is input, the control unit starts supplying the electric power to the plural image processing units based on an input of the first operation information.

15. The image processing apparatus according to claim 14, wherein in a case where the first operation information is input, the control unit starts supplying the electric power to the plural image processing units to which the electric power is not supplied based on an input of the first operation information.

16. The image processing apparatus according to claim 13, wherein one of the image processing units is a reading unit, and another of the image processing units is a print unit.

* * * * *